US005359336A

United States Patent [19]

Yoshida

[11] Patent Number: 5,359,336

[45] Date of Patent: Oct. 25, 1994

[54] CIRCULARLY POLARIZED WAVE GENERATOR AND CIRCULARLY POLARIZED WAVE RECEIVING ANTENNA

[75] Inventor: Yoshikazu Yoshida, Tokyo, Japan

[73] Assignee: Sony Corporation, Tokyo, Japan

[21] Appl. No.: 36,153

[22] Filed: Mar. 24, 1993

[30] Foreign Application Priority Data

Mar. 31, 1992 [JP] Japan ..... 4-103967

[51] Int. Cl.[5] ..... H01Q 19/00

[52] U.S. Cl. ..... 343/756; 343/775; 343/786; 333/21 A; 333/26

[58] Field of Search ..... 343/756, 772, 775, 786, 343/700 MS; 333/21 A, 26

[56] References Cited

U.S. PATENT DOCUMENTS

| | | | |
|---|---|---|---|
| 4,475,107 | 10/1984 | Makimoto et al. | 343/700 MS |
| 4,707,702 | 11/1987 | Withers | 333/21 A |
| 4,786,914 | 11/1988 | Wu et al. | 343/756 X |
| 5,006,858 | 4/1991 | Shirosaka | 343/700 MS |
| 5,043,683 | 8/1991 | Howard | 343/786 X |

FOREIGN PATENT DOCUMENTS

| | | | |
|---|---|---|---|
| 0099803 | 6/1982 | Japan | 343/700 MS |
| 0176302 | 9/1985 | Japan | 333/21 A |

*Primary Examiner*—Donald Hajec
*Assistant Examiner*—Tan Ho
*Attorney, Agent, or Firm*—Lewis H. Eslinger; Jay H. Maioli

[57] ABSTRACT

A circularly polarized generator for transmitting circularly polarized transmitted electromagnetic waves and a circularly polarized wave reception antenna for receiving the electromagnetic waves is disclosed. A crank-shaped conductor pattern composed of a pair of U-shaped portions connected to each other so that the open sides of the letter U are directed oppositely to each other is affixed on a substrate, and has its one end arranged as a signal transmitting and receiving end for achieving minimum transmission losses and optimum axial ratio or intersecting polarized wave component discriminating factor as well as for reducing the size and weight and assuring ease of manufacture.

15 Claims, 8 Drawing Sheets

CIRCULARLY POLARIZED WAVE GENERATOR AND CIRCULARLY POLARIZED WAVE RECEIVING ANTENNA

BACKGROUND OF THE INVENTION

1. Field of the Invention

This invention relates to a circularly polarized wave generator for transmitting circularly polarized electromagnetic and a circularly polarized wave receiving antenna for receiving the circularly polarized electromagnetic waves.

2. Description of the Related Art

Such circularly polarized wave generator and circularly polarized wave receiving antenna is shown for example in FIGS. 1 and 2. The circularly polarized wave generator and circularly polarized wave receiving antenna shown in FIGS. 1 and 2 includes a cylindrical waveguide 102, a linear receiving bar 101 inserted through the wall of the proximal part of the waveguide 102 at a right angle thereto, and a dielectric plate 103 arranged within the waveguide 102. The dielectric plate 103 is a flat plate having a width equal to the inner diameter of the waveguide 102 and placed with its longitudinal axis in alignment with the axis of the waveguide 102.

A circularly polarized wave is incident on the receiving antenna at an open distal end of the waveguide 102 from the direction shown by arrow e in FIG. 2. The field amplitude component of the circularly polarized wave perpendicular to the major surface of the dielectric plate 103 is transmitted through the waveguide 102 without being affected by the dielectric plate 103 to reach the reception bar 101. The field amplitude component of the circularly polarized wave parallel to the major surface of the dielectric plate 103 is retarded by being transmitted through the dielectric plate 103 to reach reception bar 101. The field amplitude component or the circularly polarized wave transmitted through the dielectric plate 103 is delayed by $\frac{1}{4}\lambda$ where $\lambda$ represents wavelength, when it reaches the reception bar 101. The result is that the field amplitude components of the circularly polarized wave perpendicular and parallel to the major surface of the dielectric plate 103 reach the reception bar 101 simultaneously so as to be outputted via reception bar 101 as reception signals.

It is noted that, if the electromagnetic waves are transmitted via reception bar 101, the circularly polarized wave receiving antenna may be used as a circularly polarized wave generator for transmitting circularly polarized wave at the distal end of the waveguide 102 by the operation of the dielectric plate 103.

Also known in the field is a circularly polarized wave reception antenna made up of a cylindrically-shaped waveguide 102 and a pair of reception bars 104*a*, 104*b* inserted through the wall of the waveguide 102 in a direction perpendicular to the axis of the waveguide, as shown in FIGS. 3 and 4. The reception bars 104*a*, 104*b* are arranged at right angles to each other and have their distal ends in the vicinity of the axis of the waveguide 102. These reception bars 104*a*, 104*b* have their proximal sides connected to each other via a synthesizer 105 and to a reception signal output end 104. The synthesizer 105 is designed so that the distance from the reception bar 104*a* to the output terminal 104 is longer by $\frac{1}{4}\lambda$ than the distance from the other reception bar 104*b* to the output terminal 104.

In the present circularly polarized wave reception antenna, the circularly polarized wave is incident on the open distal end of the waveguide 102 from the direction shown by arrow e in FIG. 4. The reception bar 104*a* receives field amplitude components parallel to the axis of the reception bar 104*a* to transmit the components via synthesizer 105 to the reception signal output terminal 104. The other reception bar 104*b* receives field amplitude components parallel to the axis of the reception bar 104*b* to transmit the components via synthesizer 105 to the reception signal output terminal 104. The field amplitude components received by the reception bar 104*a* on reaching the output end 104 is delayed by synthesizer 105 by $\frac{1}{4}\lambda$ with respect to the field amplitude component received by the other reception bar 104*b*. The result is that the field amplitude components of the circularly polarized wave parallel to the axes of the reception bars 104*a*, 104*b* reach the reception signal output terminal 104 simultaneously so as to be outputted via reception signal output terminal 104 as reception signals.

It is noted that, if the electrical waves are entered at the reception signal output terminal 104, the circularly polarized wave receiving antenna may be used as a circularly polarized wave generator for transmitting circularly polarized waves at the distal end of the waveguide 102 by the operation of synthesizer 105.

Also known in the field is a circularly polarized wave reception antenna made up of a reception unit 106 and a parabola-shaped reflector plate 108, as shown in FIGS. 5 and 6. The reception unit 106 is supported by the reflector plate 108 via a supporting bar 107. Further, the parabola-shaped reflector plate 108 is supported by the supporting shaft 109 so that the center axis of the concave portion thereof is aimed at, for example, a geostationary satellite.

The reception unit 106 includes a waveguide member 110 made up of a waveguide portion 110*a* and a cone-shaped field horn 110*b* connected to the distal end of the waveguide portion 110*a*, and a converter unit 112 attached to the waveguide member 110 via a substrate 111 fitted with the above-mentioned reception bar. The reception unit 106 is supported so that the field horn 110*b* is caused to face the parabola-shaped reflector plate 108. The field horn 110*b* is flared at its distal end, that is at the side of the parabola-shaped reflector plate 108.

Meanwhile, in the above-described circularly polarized wave generator and circularly polarized wave reception antenna, provided with the waveguide 102 and the dielectric plate 103, it is necessary for the dielectric plate 103 provided within the waveguide 102 to be of such a length as to produce a delay corresponding to $\frac{1}{4}\lambda$ in the field amplitude components parallel to the major surface of the dielectric plate. The dielectric plate has its longitudinal direction parallel to the incident and/or radiating direction of the circularly polarized wave.

That is, the above-described circularly polarized wave generator and circularly polarized wave receiving antenna are of a stereo structure including both the incident and/or radiating direction for the circularly polarized wave and the direction perpendicular thereto so that it can not be reduced in size and thickness for providing a substantially planar structure. In addition, the dielectric plate 103 has to be mounted in position within the waveguide 102, thus complicating the structure and the production process.

On the other hand, in the above-described circularly polarized wave generator and the circularly polarized wave reception antenna, provided with the waveguide 102 and the synthesizer 105, it is necessary for the synthesizer 105 to have a transmission path of such a length as to cause a delay corresponding to $\frac{1}{4}\lambda$ in one of the field amplitude components. The result is that, because of transmission losses at the synthesizer 105, it is difficult with the present circularly polarized wave generator and circularly polarized wave reception antenna to realize good reception and transmission characteristics, while it is difficult to reduce its size because of a larger space to be reserved for the synthesizer 105.

OBJECTS OF THE INVENTION

It is an object of the present invention to provide a circularly polarized wave generator and a circularly polarized wave reception antenna which is free from the above-mentioned problems.

It is another object of the present invention to provide a circularly polarized wave generator and a circularly polarized wave reception antenna which may be flat-shaped and reduced in size and thickness.

It is a further object of the present invention to provide a circularly polarized wave generator and a circularly polarized wave reception antenna free from transmission losses of electromagnetic waves and having optimum reception and transmission characteristics.

Other objects and advantages of the present invention will become apparent from the following description of the preferred embodiments and the claims.

SUMMARY OF THE INVENTION

In view of the above-mentioned objects, the present invention provides a circularly polarized wave generator for transmitting circularly polarized waves comprising a substrate and a conductor pattern provided on the substrate. The conductor pattern is made up of a first straight section of a length approximately equal to $\frac{3}{8}\lambda$, having its proximal end designed as a reception end for transmitted electromagnetic waves with a wavelength $\lambda$, a second straight section of a length equal to approximately $\frac{1}{8}\lambda$, contiguous to the first straight section from the distal end of the first straight section and extended in one lateral direction perpendicular to the first straight section, a third straight section of a length approximately $\frac{1}{4}\lambda$, contiguous to the second straight section from the distal end of the second straight section and extended parallel to the first straight section in the direction of extension of the first straight section, a fourth straight section of a length equal to approximately $\frac{1}{4}\lambda$, contiguous to the third straight section from the distal end of the third straight section and extended in the opposite lateral direction perpendicular to the third straight section, a fifth straight section of a length approximately $\frac{1}{4}\lambda$, contiguous to the fourth straight section from the distal end of the fourth straight section and extended parallel to the first straight section in the direction of extension of the first straight section, and a sixth straight section of a length approximately equal to $\frac{1}{8}\lambda$, contiguous to the fifth straight section from the distal end of the fifth straight section and extended in the first lateral direction perpendicular to the fifth straight section.

The present invention also provides a circularly polarized wave reception antenna for receiving circularly polarized waves comprising a substrate and a plurality of conductor patterns formed on the substrate, wherein the conductor patterns each are made up of a first straight section of a length approximately equal to $\frac{3}{8}\lambda$, having its proximal end designed as a reception end for received electromagnetic waves with a wavelength $\lambda$, a second straight section of a length equal to approximately $\frac{1}{8}\lambda$, contiguous to the first straight section from the distal end of the first straight section and extended in one lateral direction perpendicular to the first straight section, a third straight section of a length approximately $\frac{1}{4}\lambda$, contiguous to the second straight section from the distal end of the second straight section and extended parallel to the first straight section in the direction of extension of the first straight section, a fourth straight section of a length equal to approximately $\frac{1}{4}\lambda$, contiguous to the third straight section from the distal end of the third straight section and extended in the opposite lateral direction perpendicular to the third straight section, a fifth straight section of a length approximately $\frac{1}{4}\lambda$, contiguous to the fourth straight section from the distal end of the fourth straight section and extended parallel to the first straight section in the direction of extension of the first straight section, and a sixth straight section of a length approximately equal to $\frac{1}{8}\lambda$, contiguous to the fifth straight section from the distal end of the fifth straight section and extended in first lateral direction perpendicular to the fifth straight section transmitting/reception ends of the conductor patterns are sequentially connected to one another and to a common reception signal output terminal.

The circularly polarized wave reception antenna also includes, besides the above-mentioned substrate of the circularly polarized wave generator, a parabola-shaped reflection plate arranged facing the substrate of the circularly polarized wave generator substantially at right angles thereto.

With the above-described circularly polarized wave generator, when electromagnetic signals having a wavelength $\lambda$ are supplied at the transmitting and receiving end which is the proximal end of the first straight section of the conductor patterns on the substrate, the first to sixth straight sections radiate circularly polarized waves perpendicular to the substrate. On the other hand, when circularly polarized electromagnetic waves are received in a direction perpendicular to the substrate, the first to sixth straight sections receive these signals to output the electromagnetic waves at the transmitting and receiving end. With the circularly polarized wave generator, since the straight sections making up the conductor pattern are arranged in a plane, the generator may be reduced in thickness and simplified in construction.

With the above-described circularly polarized wave reception antenna, the conductor patterns receive the circularly polarized electromagnetic waves and transmit the received signals to their transmitting and receiving ends and to the common reception signal output terminal.

DETAILED DESCRIPTION OF THE PREFERRED EMBODIMENTS

A circularly polarized wave generator according to the present invention has a conductor pattern deposited on one major surface of a substrate 3, as shown in FIGS. 7 to 10.

The substrate 3 is flat-shaped and formed of an insulating material. The conductor pattern 1 is deposited on the substrate 3 by a technique such as etching. The conductor pattern 1 is formed on one major surface of the substrate 3 as a foil or film of copper or like electrically conductive material. The conductor pattern 1 is made up of first to sixth straight sections 1*a*, 1*b*, 1*c*, 1*d*, 1*e* and 1*f* which are connected to one another into a substantially crank-shaped profile.

Figure 9:
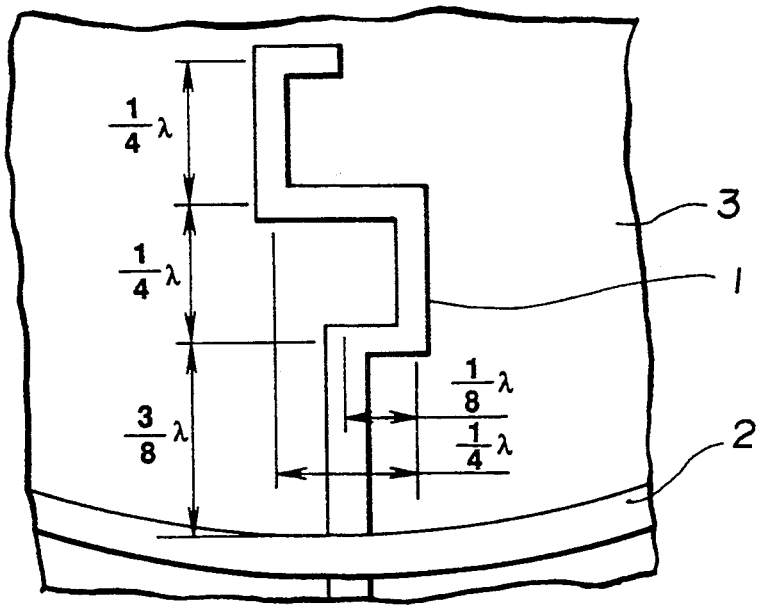
FIG. 9 is an enlarged front view showing essential parts of the circularly polarized wave generator shown in FIG. 7.
Figure 10:
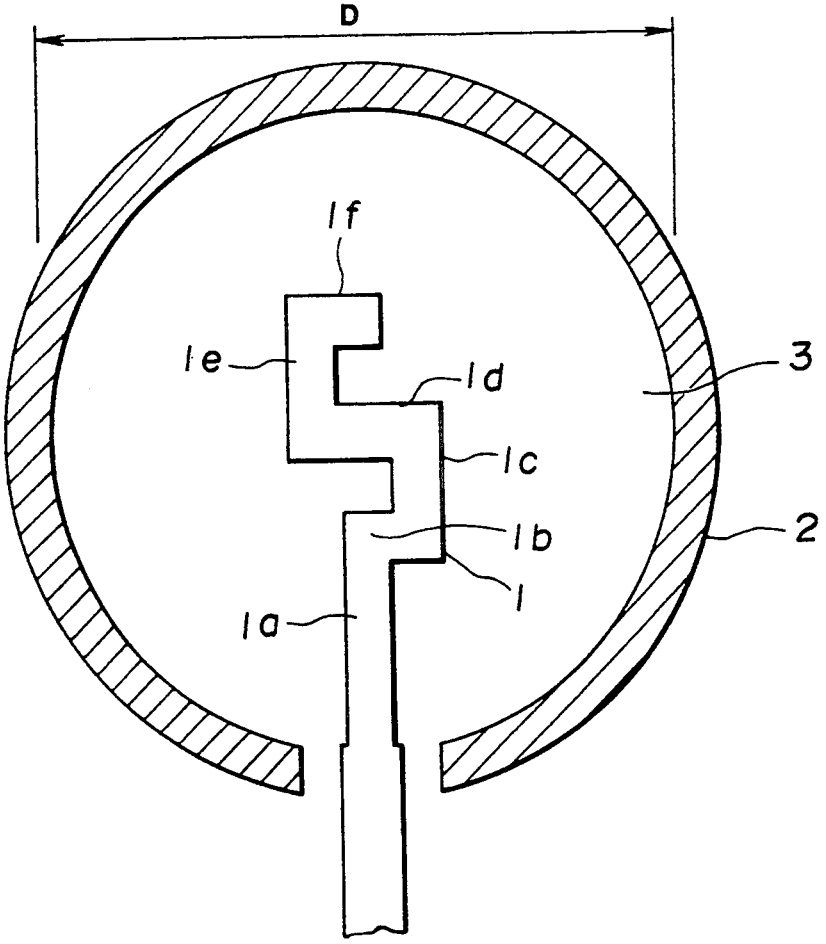
FIG. 10 is an enlarged front view showing the arrangement of the circularly polarized wave generator shown in FIG. 7, with portions thereof broken away.

That is, the conductor pattern 1 has the first straight section 1*a* with a length approximately equal to $\frac{3}{8}\lambda$ having its proximal end as the reception end for transmission signals of the wavelength $\lambda$, as shown in FIGS. 9 and 10. The reception end is extended from and connected to a so-called strip line section formed on the substrate 3. This strip line section is connected to a converter circuit, not shown.

The second straight section 1*b* of a length of approximately $\frac{1}{8}\lambda$, extended in one lateral direction of and at right angles to the first straight section 1*a*, is contiguous to the distal end of the first straight section 1*a*. The third straight section 1*c* of a length of approximately $\frac{1}{4}\lambda$, extended parallel to and in the direction of extension of the first straight section 1*a*, is contiguous to the distal end of the second straight section 1*b*. The fourth straight section 1*d* of a length of approximately $\frac{1}{4}\lambda$, extended in the other lateral direction of and at right angles to the third straight section 1*c*, is contiguous to the distal end of the third straight section 1*c*. The fifth straight section 1*e* of a length of approximately $\frac{1}{4}\lambda$, extended parallel to and in the direction of extension of the first straight section 1*a*, is contiguous to the distal end of the fourth straight section 1*d*. The sixth straight section 1*f* of a length of approximately $\frac{1}{8}\lambda$, extended in the first lateral direction of and at right angles to the fifth straight section 1*e*, is contiguous to the distal end of the fifth straight section 1*e*.

In this manner, with the conductor pattern 1, the second straight section 1*b* and the sixth straight section 1*f* are positioned and shaped symmetrically with respect to the fourth straight section 1*d*, while the third straight section 1*c* and the fifth straight section 1*e* are also positioned and shaped symmetrically with respect to the fourth straight section 1*d*.

Meanwhile, the conductor pattern 1 is of a constant width in order to take account of signal transmission losses. In the present embodiment, the above-mentioned one and other lateral directions are the right and left directions with respect to the substrate 3 as viewed in FIG. 10.

The circularly polarized wave generator is arranged within the waveguide 2. That is, the substrate 3 is so arranged that the conductor pattern 1 is placed within the waveguide 2. The substrate 3 is positioned within the cylindrically-shaped waveguide 2, which is open at its forward end and closed at its rear end, so that the conductor pattern is placed within the waveguide 2 with the major surface of the substrate at right angles to the waveguide axis. The waveguide 2 has a portion led out of the waveguide 2 and formed with the above-mentioned strip line. The inner diameter of the waveguide 2, indicated by letter D in FIG. 10, is selected to be large enough to cover up the conductor pattern 1 with the fourth straight section 1*d* as a center.

Figure 8:
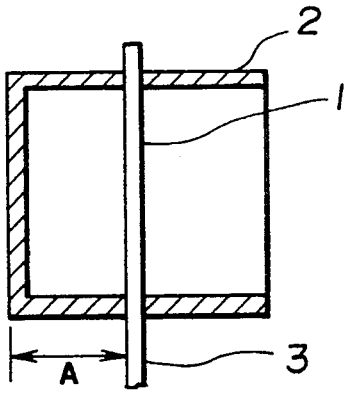
FIG. 8 is a side view showing the arrangement of the circularly polarized wave generator shown in FIG. 7, with portions thereof broken away.

The substrate 3 has its major surface carrying the conductor pattern 1 directed to the forward end of the waveguide 2. Further, the substrate 3 is supported so that the distance to the rear end of the waveguide 2 as shown by letter A in FIG. 8 is on the order of $\frac{1}{4}\lambda$.

When transmitted signals in the linearly polarized state are supplied at the transmission/reception end of the circularly polarized wave generator, circularly polarized waves are radiated via the conductor pattern 1 in a direction perpendicular to the major surface of the substrate 3, that is towards the forward side of the waveguide 2. The circularly polarized wave generator may also be employed as a circularly polarized wave reception antenna. In this case, the circularly polarized wave generator receives the circularly polarized waves, incident perpendicularly on the major surface of the substrate 3 from the forward side of the waveguide 2, by the conductor pattern 1, to output the received electrical waves as linearly polarized reception signals at the transmission/reception end.

Figure 15:
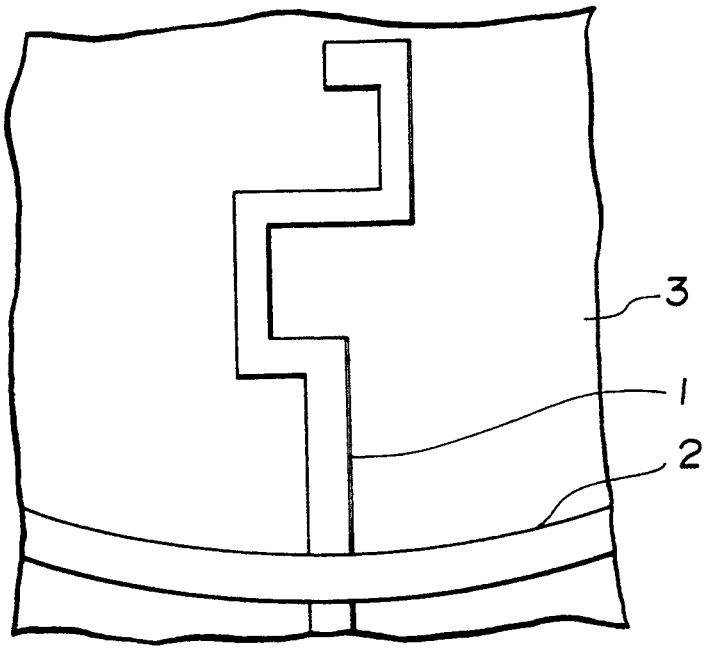
FIG. 15 is an enlarged front view showing essential parts of the circularly polarized wave generator of FIG. 7 arranged for reception and transmission of left polarized waves.

Meanwhile, in the present embodiment, the conductor pattern 1 is designed for receiving right polarized waves. If the conductor pattern 1 is profiled as a mirror image with respect to the above-described profile, that is if the conductor pattern 1 is so placed that the above-mentioned one and other lateral directions are on the left and right sides of the substrate 1 when viewed in FIGS. 9 and 15, the conductor pattern 1 is capable of receiving left polarized waves.

Figure 12:
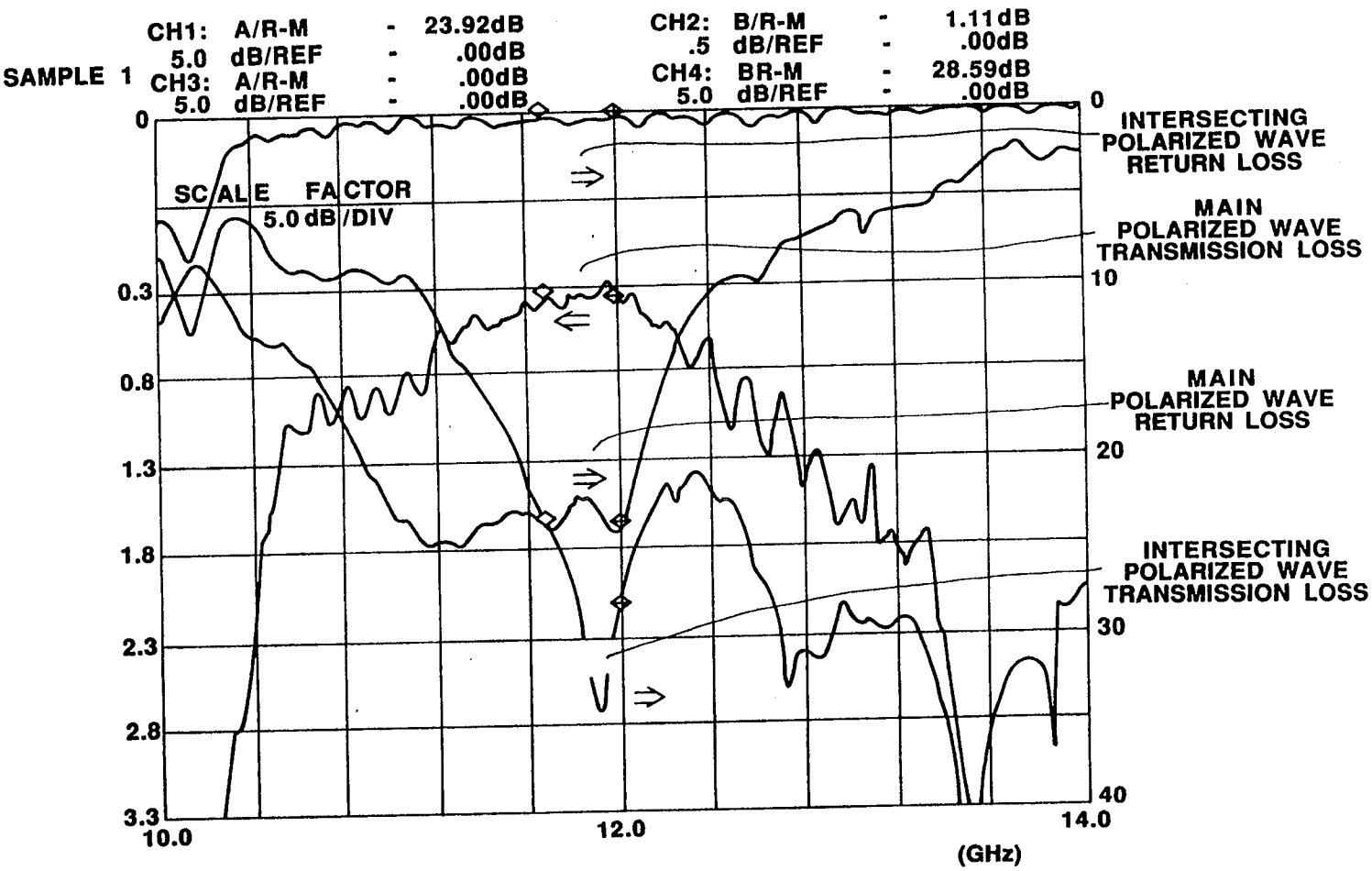
FIG. 12 is a graph showing reception characteristics for a first sample with the use of the circularly polarized wave generator of FIG. 7 as a circularly polarized wave reception antenna.
Figure 13:
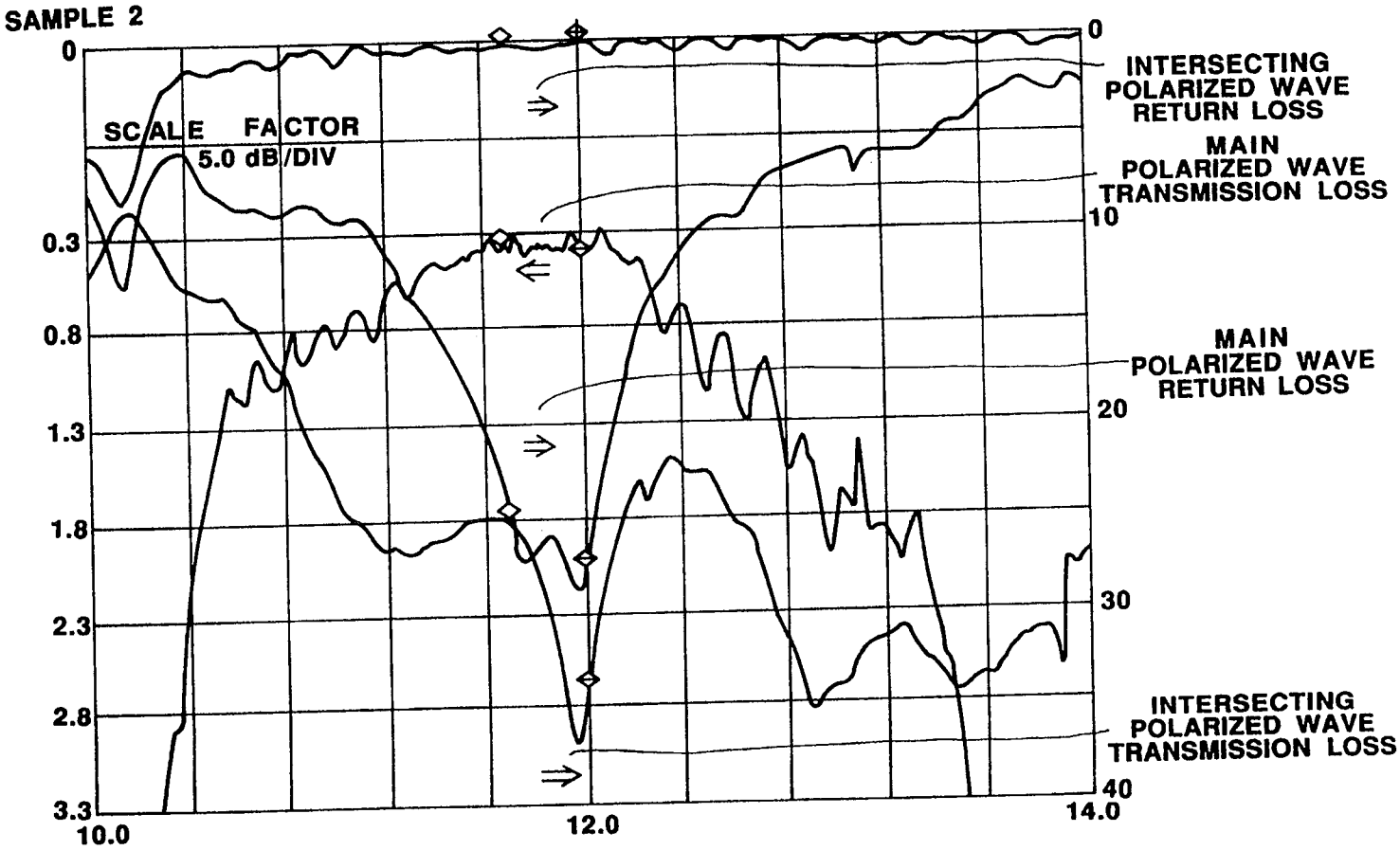
FIG. 13 is a graph showing reception characteristics for a second sample with the use of the circularly polarized wave generator of FIG. 7 as a circularly polarized wave reception antenna.

The circularly polarized wave generator according to the present invention was constructed as a circularly polarized wave reception antenna for receiving satellite broadcasting waves, and reception characteristics were measured for fist and second samples. It was found that, for the frequency range of the broadcasting satellite of 11.7 GHz to 12.0 GHz, conversion losses were 0.4 dB, return losses were 0.4 dB the intersecting polarized wave discrimination factor (XPD) was 21.9 dB, as shown in FIGS. 12 and 13. Right circularly polarized waves were used as broadcasting electromagnetic waves. That is, the present circularly polarized wave reception antenna has characteristics of shutting off left polarized waves and satisfactorily receiving only main polarized waves, that is right polarized waves.

FIGS. 12 and 13 show reception characteristics the first and second samples, respectively. In these figures, the frequency range for satellite broadcasting is indicated by thombus marks. The reception characteristics of these samples are such that, in the frequency range for satellite broadcasting, transmission losses are reduced to as low as 0.4 dB (on the left hand ordinate) and return losses are 22 dB or higher (on the right hand ordinate) insofar as right polarized waves or main polarized waves are concerned. On the other hand, reception characteristics of the samples are such that, in the frequency range for satellite broadcasting, transmission losses are on the order of 1.8 dB on the left hand ordinate and return losses are less than 1 dB on the right hand ordinate, insofar as the left polarized waves are concerned.

Figure 14:
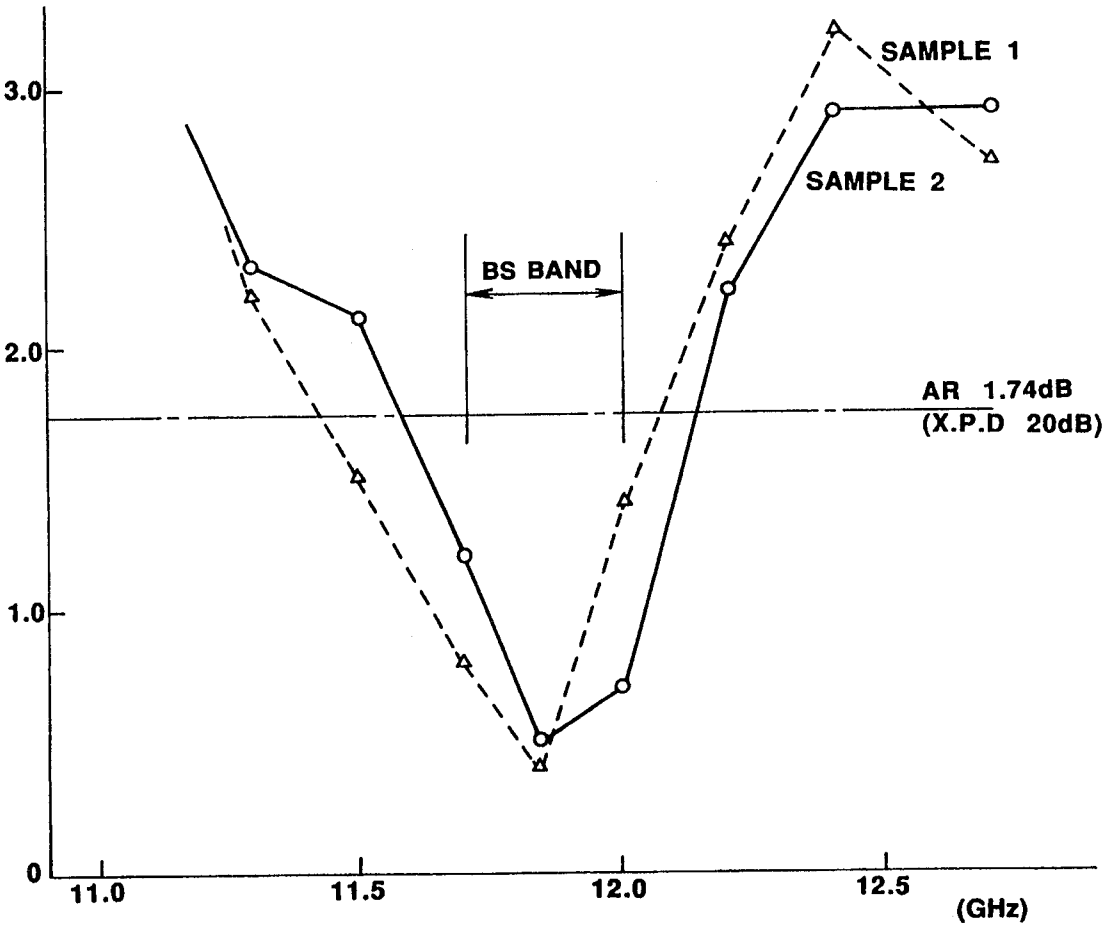
FIG. 14 is a graph showing axial ratio characteristics for the first and second samples with the use of the circularly polarized wave generator of FIG. 7 as a circularly polarized wave reception antenna.

The axial ratio (AR), as measured for the first and second samples, was 1.74 dB or less in the frequency range for satellite broadcasting, as shown in FIG. 14. The axial ratio of 1.74 dB or less corresponds to about 200 dB or more in terms of the intersecting polarization discrimination factor (XPD).

Figure 11:
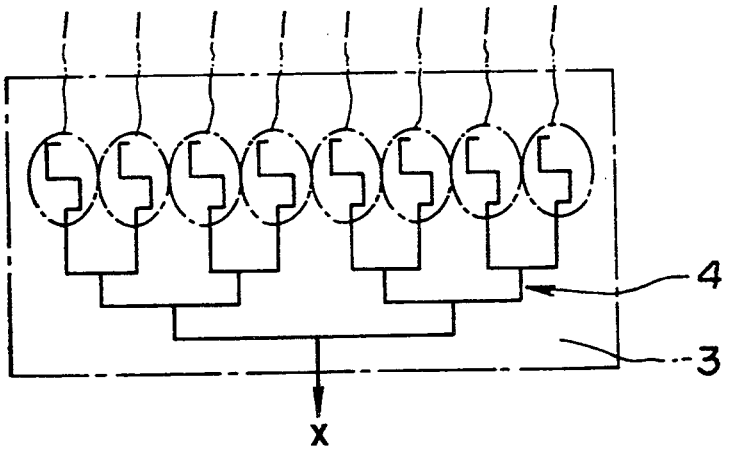
FIG. 11 is a front view showing an arrangement of a circularly polarized wave reception antenna according to the present invention.

The circularly polarized wave reception antenna according to the present invention may be arranged as a planar antenna by depositing plural conductor patterns 1 on one and the same substrate 3, as shown in FIG. 11. Each of the conductor patterns 1 in the circularly polarized wave reception antenna is profiled similarly to the conductor pattern 1 of the above-described conductor pattern 1.

In the circularly polarized wave reception antenna, shown in FIG. 11, two neighboring conductor patterns 1 are paired and have their transmitting/reception ends connected to each other by connecting patterns 4, and two other neighboring connecting patterns are paired and connected to each other by another connecting pattern 4. The conductor patterns 1, thus connected to one another by the connecting patterns 4, are connected to a reception signal output terminal, shown by arrow x in FIG. 11.

With the above-described circularly polarized wave reception antenna, the conductor patterns each receive the main polarized waves, which are right circularly polarized waves. Signals received by these conductor patterns 1 are sequentially combined so as to be outputted as reception signals at the reception signal output terminal.

The circularly polarized wave reception antenna according to the present invention may be arranged using the above-described circularly polarized wave generator and the parabola-shaped reflector plate. In such case, the circularly polarized wave generator is mounted with the major surface of the substrate 3 carrying the conductor pattern 1 facing the mid part of the concave front surface of the parabola-shaped reflector plate.

Figure 1:
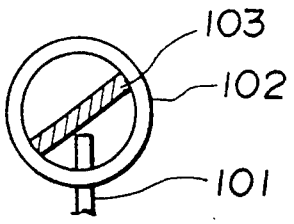
FIG. 1 (PRIOR ART)
FIG. 1 is a front view showing an arrangement of a conventional circularly polarized wave generator.
Figure 2:
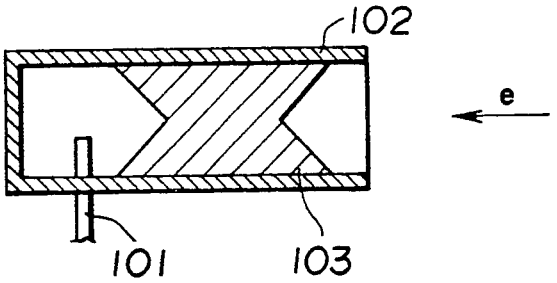
FIG. 2 (PRIOR ART)
FIG. 2 is a side view showing the arrangement of the circularly polarized wave generator shown in FIG. 1, with a part thereof broken away.
Figure 3:
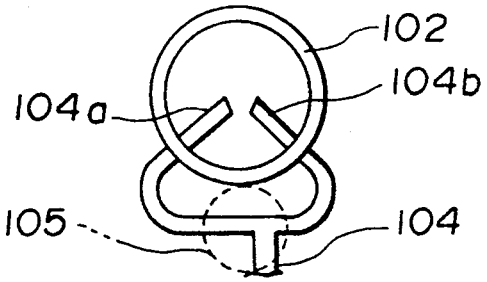
FIG. 3 (PRIOR ART)
FIG. 3 is a front view showing an arrangement of another conventional circularly polarized wave generator.
Figure 4:
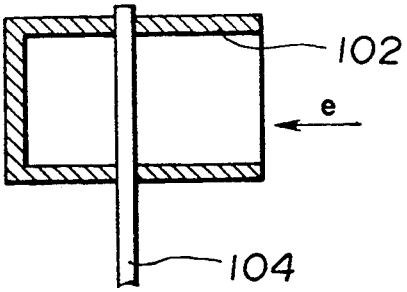
FIG. 4 (PRIOR ART)
FIG. 4 is a side view showing the arrangement of the circularly polarized wave generator shown in FIG. 3, with a part thereof broken away.
Figure 5:
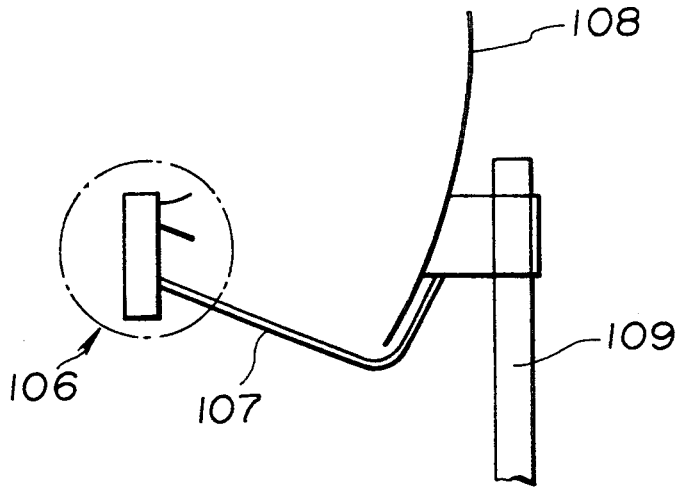
FIG. 5 (PRIOR ART)
FIG. 5 is a side view showing an arrangement of a circularly polarized wave reception antenna having a parabola-shaped reflector plate.
Figure 6:
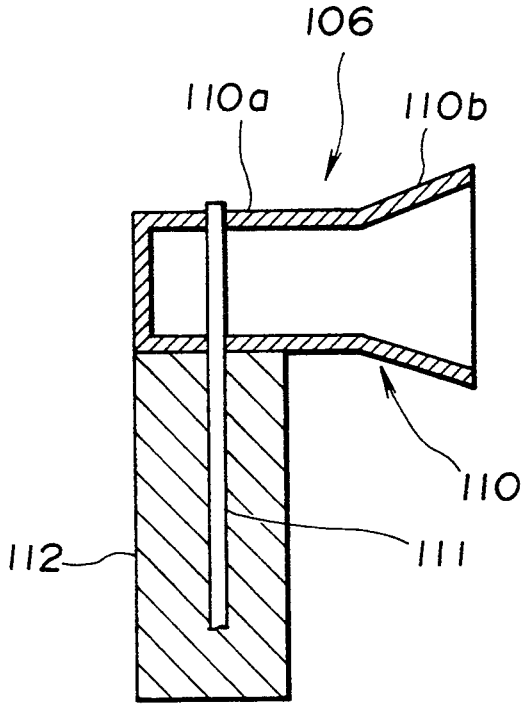
FIG. 6 (PRIOR ART)
FIG. 6 is an enlarged side view showing the arrangement of the circularly polarized wave reception antenna shown in FIG. 5.
Figure 7:
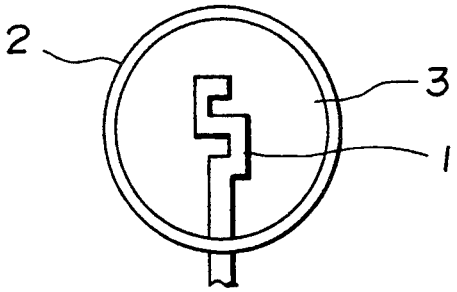
FIG. 7 is a front view showing a circularly polarized wave generator according to the present invention, designed for reception and transmission of right polarized waves.

With the present circularly polarized wave reception antenna, the circularly polarized wave generator receives the circularly polarized waves reflected and converged by the parabola-shaped reflector plate. In such case, since the circularly polarized waves have their direction of polarization reversed when reflected by the parabola-shaped reflector plate, the circularly polarized wave generator for left polarized waves shown in FIG. 15 and the circularly polarized wave generator for right polarized waves shown in FIGS. 7, 9 and 10 are used for receiving the right polarized waves and left polarized waves, respectively.

What is claimed is:

1. A circularly polarized wave generator for transmitting circularly polarized waves comprising:

a tubular waveguide having an open front end and a closed rear end;

a substrate in the form of a flat plate having a major surface substantially the same Size as said open end of said waveguide and arranged in said waveguide between said front end and said rear end, so that said major surface is substantially perpendicular to a longitudinal axis of said waveguide; and a conductor pattern provided on said major surface of said substrate forming said front end of said waveguide, said conductor pattern being made up of a first straight section of a length approximately equal to $\frac{3}{8}\lambda$ having a proximal end as a reception end for transmitted electromagnetic waves with a wavelength $\lambda$, a second straight section of a length equal to approximately $\frac{1}{8}\lambda$ contiguous to said first straight section from a distal end of said first straight section and extended in a first lateral direction perpendicular to said first straight section, a third straight section of a length equal to approximately $\frac{1}{4}\lambda$ contiguous to said second straight section from a distal end of said second straight section and extended parallel to said first straight section in a direction of extension of said first straight section, a fourth straight section of a length equal to approximately $\frac{1}{4}\lambda$ contiguous to said third straight section from a distal end of said third straight section and extended in the opposite lateral direction perpendicular to said third straight section, a fifth straight section of a length equal to approximately $\frac{1}{4}\lambda$ contiguous to said fourth straight section from a distal end of said fourth straight section and extended parallel to said first straight section in the direction of extension of said first straight section, and a sixth straight section of a length approximately equal to $\frac{1}{8}\lambda$ contiguous to said fifth straight section from a distal end of said fifth straight section and extended in said first lateral direction perpendicular to said fifth straight section.

2. A circularly polarized wave generator as claimed in claim 1 wherein said proximal end of said conductor pattern formed on said substrate as said reception end is connected to a strip line portion formed on said substrate and passing through a side wall of said wave guide.

3. A circularly polarized wave generator as claimed in claim 1 wherein said waveguide is cylindrically shaped.

4. A circularly polarized wave generator as claimed in claim 3 wherein an inner diameter of said waveguide is sized to surround said conductor pattern formed on said substrate with said fourth straight section as a center.

5. A circularly polarized wave generator as claimed in claim 1 wherein said substrate on which said conductor pattern is formed is supported at a position such that a distance from the substrate to the closed rear end of the waveguide is $\frac{1}{4}\lambda$ of the transmitted electromagnetic waves.

6. A circularly polarized wave reception antenna for receiving circularly polarized waves comprising;

a tubular waveguide having an open front end and a closed rear end;

a substrate in the form of a flat plate having a major surface substantially the same size as said open front end of said waveguide and arranged in said waveguide between said front end and said rear end so that said major surface is substantially perpendicular to a longitudinal axis of said waveguide; and a plurality of conductor patterns formed on said major surface of said substrate facing said front end of said waveguide, said plurality of conductor patterns each being made up of a first straight section of a length approximately equal to $\frac{3}{8}\lambda$ having a proximal end as a reception end for received electromagnetic waves with a wavelength $\lambda$, a second straight section of a length equal to approximately $\frac{1}{8}\lambda$ contiguous to said first straight section from a distal end of said first straight section and extended in a first lateral direction perpendicular to said first straight section, a third straight section of length equal to approximately $\frac{1}{4}\lambda$ contiguous to said second straight section from a distal end of said second straight section and extended parallel to said first straight section in a direction of extension of said first straight section, a fourth straight section of a length equal to approximately $\frac{1}{4}\lambda$ contiguous to said third straight section from a distal end of said third straight section and extended in the opposite lateral direction perpendicular to said third straight section, a fifth straight section of a length equal to approximately $\frac{1}{4}\lambda$ contiguous to said fourth straight section from a distal end of said fourth straight section and extended parallel to said first straight section in the direction of extension of said first straight section, and a sixth straight section of a length approximately equal to $\frac{1}{8}\lambda$ contiguous to said fifth straight section from a distal end of said fifth straight section and extended in said first lateral direction perpendicular to said fifth straight section, each said reception end of said plurality of conductor patterns being sequentially connected to one another and to a common reception signal output terminal.

7. A circularly polarized wave reception antenna as claimed in claim 6 wherein said proximal ends of said plurality of conductor patterns formed on said substrate as reception ends are connected to a strip line portion formed on said substrate and passing through a side wall of said waveguide.

8. A circularly polarized wave reception antenna as claimed in claim 6 wherein said waveguide is cylindrically shaped.

9. A circularly polarized wave reception antenna as claimed in claim 8 wherein an inner diameter of said waveguide is sized to surround said conductor patterns formed on said substrate with said fourth straight section as a center.

10. A circularly polarized wave reception antenna as claimed in claim 6 wherein said substrate on which said plurality of conductor patterns is formed is supported at a position such that the distance from the substrate to said closed rear end of the waveguide is $\frac{1}{4}\lambda$ of the transmitted electromagnetic waves.

11. A circularly polarized wave reception antenna as claimed in claim 6 wherein two of said plurality of conductor patterns are paired and have their reception ends connected to each other via connection patterns.

12. A circularly polarized wave reception antenna as claimed in claim 11 wherein two of said paired conductor patterns are additionally paired and connected to each other via additional connection patterns.

13. A circularly polarized wave reception antenna as claimed in claim 12 wherein said additionally paired conductor patterns are connected via final connection patterns to a reception signal output terminal.

14. A circularly polarized wave reception antenna for receiving circularly polarized electromagnetic waves comprising:

a tubular waveguide having an open front end and a closed rear end;

a substrate in the form of a flat plate having a major surface substantially the same size as said open front end of said waveguide and arranged in said waveguide between said front end and said rear end, so that said major surface is substantially perpendicular to a longitudinal axis of said waveguide;

a conductor pattern formed on said major surface of said substrate facing said open end of said waveguide, said conductor pattern being made up of a first straight section of a length approximately equal to $\frac{3}{8}\lambda$ having a proximal end as a reception end for transmitted electromagnetic waves with a wavelength $\lambda$, a second straight section of a length equal to approximately $\frac{1}{8}\lambda$ contiguous to said first straight section from a distal end of said first straight section and extended in a first lateral direction perpendicular to said first straight section, a third straight section of a length equal to approximately $\frac{1}{4}\lambda$ contiguous to said second straight section from a distal end of said second straight section and extended parallel to said first straight section in a direction of extension of said first straight section, a fourth straight section of a length equal to approximately $\frac{1}{4}\lambda$ contiguous to said third straight section from a distal end of said third straight section and extended in the opposite lateral direction perpendicular to said third straight section, a fifth straight section of a length equal to approximately $\frac{1}{4}\lambda$ contiguous to said fourth straight section from a distal end of said fourth straight section and extended parallel to said first straight section in the direction of extension of said first straight section, and a sixth straight section of a length approximately equal to $\frac{1}{8}\lambda$ contiguous to said fifth straight section from a distal end of said fifth straight section and extended in said first lateral direction perpendicular to said fifth straight section; and a parabola-shaped reflector plate mounted facing said open end of said waveguide in a direction substantially perpendicular to said longitudinal axis thereof.

15. A circularly polarized wave reception antenna as claimed in claim 14 wherein said conductor pattern of said circularly polarized wave generator is mounted on a surface of said substrate facing a mid portion of a concave front surface of said parabola-shaped reflector plate.

* * * * *